US005423957A

United States Patent [19]

Herrmann et al.

[11] Patent Number: 5,423,957

[45] Date of Patent: Jun. 13, 1995

[54] ELECTROLYTIC PROCESS FOR DISSOLVING PLATINUM, PLATINUM METAL IMPURITIES AND/OR PLATINUM METAL ALLOYS

[75] Inventors: Sigrid Herrmann; Uwe Landau, both of Berlin, Germany

[73] Assignee: Schott Glaswerke, Mainz, Germany

[21] Appl. No.: 170,423

[22] Filed: Dec. 20, 1993

[30] Foreign Application Priority Data

Dec. 18, 1992 [DE] Germany ..... 42 43 698.2

[51] Int. Cl.[6] ..... C25C 1/20

[52] U.S. Cl. ..... 204/94; 204/109

[58] Field of Search ..... 204/140, 86, 94, 109, 204/111

[56] References Cited

U.S. PATENT DOCUMENTS

| | | | |
|---|---|---|---|
| 1,467,202 | 9/1923 | Slatineau | 204/111 |
| 4,382,845 | 5/1983 | Hubred | 204/111 |
| 4,775,452 | 10/1988 | Kuninaga | 204/146 |

FOREIGN PATENT DOCUMENTS

| | | |
|---|---|---|
| 0221187 | 5/1987 | European Pat. Off. . |
| 0242111 | 10/1987 | European Pat. Off. . |
| 63880 | 2/1967 | Germany . |

OTHER PUBLICATIONS

Derwent Abstract of SU-496239 as Belo Phys Org. Ch, Mar. 4, 1976.

Ullmann Chemical Encyclopedia, 1992, Month not Available pp. 91 & 92 (corres. to vol. 18, 1979, p. 708).

DATABASE WPI, Section Ch, Week 7709, Derwent Publications Ltd., & SU-A-496239, Mar. 5, 1976.

*Primary Examiner*—John Niebling
*Assistant Examiner*—Brendan Mee
*Attorney, Agent, or Firm*—Michael J. Striker

[57] ABSTRACT

The electrolytic process for dissolving platinum, platinum metal impurities and/or platinum metal alloys, in particular with contents of Rh, Pd, Ir, Au and Ag, in 6 to 8N aqueous hydrochloric acid is characterized by a dissolution process that takes place in an electrolysis cell subdivided by a cation exchanger membrane into an anode and cathode compartment containing anode and cathode respectively, and, if appropriate, in the presence of platinum metal salts or platinum metal acids, at temperatures between 50° and 110° C., under potentiostatic or voltage-controlled conditions in the range of 2.5 V to 8 V and under a current density of 0.3 to 7.0 $A/dm^2$. The potential across the anode and the cathode is controlled so that chlorine gas is generated and the anode is contacted with the aqueous hydrochloric acid solution and the chlorine gas in impulse-form.

14 Claims, No Drawings

ELECTROLYTIC PROCESS FOR DISSOLVING PLATINUM, PLATINUM METAL IMPURITIES AND/OR PLATINUM METAL ALLOYS

BACKGROUND OF THE INVENTION

The present invention relates to an electrolytic process for dissolving platinum, platinum metal impurities and/or platinum metal alloys, in particular which contain Rh, Pd, It, Au and/or Ag, in aqueous hydrochloric acid.

The platinum metals can be present in the form of solid bodies, e.g. as granulated metal, sheet metal, shavings, wire and the like.

The process according to the invention can, however, also be used to dissolve powders, silts and noble metals present in ceramics, quartz components, aluminum oxide or silicates.

The use of chlorine gas and hydrochloric acid to dissolve platinum and/or platinum metal alloys is generally known (Gmelin, Platin, Section C, page 77).

In Ullmann, Enzyklopädie der Chemie, Vol. 18, 1979, page 708, chlorine and hydrochloric acid is used for powders, silts and ore concentrates. The process operates with a 6 to 8N hydrochloric acid at a temperature of 80° C. It was observed, inter alia, that dissolved platinum metals hereby do not reduce the dissolution rate.

According to the German Patent Document DD-63880, platinum metals in the form of granulated metal, sheet metal or wire can be dissolved with chlorine and hydrochloric acid. The platinum metal salts or platinum metal acids thus formed are washed with aqueous hydrochloric acid. The hydrochloric acid and the chlorine gas are added in an alternating manner. The process operates with a constantly diminishing platinum surface. Targetted addition of hydrochloric acid is not possible. Therefore it is also impossible to produce concentrated noble metal solutions. In the case of reduced amounts of platinum metal, it is necessary to perform the process with a high chlorine surplus.

Due to the sequence of process steps, the achievable concentration of 500 g/l platinum metal and the dissolution rate of 1000 g/h described in the DD-63880 are reached only in exceptional cases. Moreover, the minimum amount of platinum metal that can be processed by the method of DD-63880 is 4 to 6 kg.

All described prior art processes have the disadvantage that, due to the use of chlorine gas with its dosage problems, they require elaborate machinery and safety technology. They are very expensive and ecologically no longer acceptable.

SUMMARY OF THE INVENTION

It is an object of the present invention to provide a process for dissolving platinum, platinum metal impurities and/or platinum metal alloys, which has a comparatively low apparatus and safety engineering expenditure and an acceptable environmental burden.

Surprisingly the solubility of the platinum or the platinum metal alloys increases significantly in the presence of platinum metal salts and/or platinum metal acids in the hydrochloric acid and that this dissolution process can be performed electrolytically.

According to the present invention, therefore the electrolytic process for dissolving platinum, platinum metal impurities and/or platinum metal alloys, in particular with contents of Rh, Pd, Ir, Au and Ag, in aqueous hydrochloric acid, is characterized in that the dissolution process occurs in an electrolysis cell subdivided by a cation exchanger membrane into an anode and cathode compartment, if suitable in the presence of platinum metal salts or platinum metal acids, under temperatures of 50° to 110° C. and potentiostatic or voltage-controlled conditions in the range of 2.5 V to 8 V and under a current density of 0.3 to 7.0 A/dm$^2$.

In the electrolysis cell the platinum metal or body containing the platinum to be dissolved is used as the anode of the electrolysis cell, while in the preferred embodiment platinum, titanium or graphite are used as the cathode of the electrolysis cell.

The cathode and anode compartments are at least partly filled with 6 to 8N hydrochloric acid, and the voltage is selected so that the chlorine gas needed for better dissolution is produced electrolytically.

By a suitable arrangement for mounting and controlling the body to be dissolved, impulse-type contact of the platinum metal with the acid containing platinum metal and the electrolytically generated chlorine gas is achieved.

The process according to the invention preferably operates under potentiostatic or voltage-controlled conditions in the range of 5 V to 7.5 V, a current density of 4.4 to 6.6 A/dm$^2$ and in a temperature range of 6.3° to 100° C., in particular 80° C. The solution in the anode and cathode compartment is heated up only at the beginning of the electrolysis. The dissolution temperature then establishes itself, since the process according to the invention operates exothermically.

The platinum metal solution displays a concentration of between 1 to 700 g/l. The best dissolution results were obtained with concentrated platinum metal solutions, preferably between 10 and 150 g/l. In the case of a platinum metal concentration of $>700$ g/l the dissolution process must be discontinued, since the platinum metal salts or acids precipitate in crystalline form.

A teflon membrane (Nafion® membrane) is generally used as the preferred cation exchanger membrane charged with sulfone acid groups.

Although hydrochloric acid in the anode compartment is used up by the generation of chlorine gas, the concentration of the hydrochloric acid remains constant, since water molecules are transported into the cathode compartment with the hydrogen ions.

Only the volume loss of the hydrochloric acid solution in the anode compartment must be compensated.

Portions of diluted hydrochloric acid in the cathode compartment are periodically removed from the cathode compartment, and the concentration loss is compensated for by addition of portions of another concentrated hydrochloric acid solution having a sufficiently high concentration to restore the original concentration of the solution in the cathode compartment. The diluted acid can be used to dilute concentrated hydrochloric acid in the anode compartment.

The process according to the invention possesses the following advantages: it operates in the region of the highest conductivity of the hydrochloric acid; it requires minimal safety engineering and equipment; it causes minimal burden on the environment; and it is far more time- and cost-efficient than the conventional processes.

Apart from Rh, Pd, Ir, Au and Ag, Cu, Fe, Co, Ni, Sb, As, Pb, Cd, Al, Mn, Mo, Si, Zn, Sn, Zr, W, Ti and Cr may also be present as components of the platinum metal impurities.

The process according to the invention will now be better understood by reference to the following examples, whose details are not to be considered as limiting the claims appended hereinbelow.

EXAMPLES

Example 1 Dissolution of Platinum 500 g of platinum granulate is dissolved in an electrolysis cell subdivided into anode and cathode compartments by a cation exchanger membrane. The anode compartment is filled with 1 liter of 8N HCl solution. The cathode compartment also contains 8N HCl solution. The platinum granulate to be dissolved is used as the anode, while the platinum, titanium or carbon is used as the cathode. The electrolysis bath is heated to a temperature of 80° C. A voltage of 5 V is applied to across the anode and cathode of the cell, and the electrolysis proceeds at a current density of 6.6 A/dm$^2$. During electrolysis the hydrochloric acid concentration in the cathode and anode compartments is monitored and readjusted.

After an electrolysis period of 20 hours, the electrolysis is discontinued. The hydrochloric platinum solution in the anode compartment has a concentration of 650 g platinum/l. The platinum granulate is dissolved until a residue of 3% platinum granulate remains.

Example 2 Dissolution of Platinum-Iridium-1

The anode compartment of an electrolysis cell subdivided by a cation exchanger membrane is filled with 250 g platinum-iridium-1 granulate and 500 ml of 8N hydrochloric acid. The cathode compartment is filled with 250 ml of 8N hydrochloric acid. A titanium sheet is used as the cathode, and the platinum-iridium-1 granules to be dissolved are used as the anode. The hydrochloric acid in the anode and cathode compartments is heated to 80° C. A voltage of 6 V is applied to the electrolysis cell and the process takes place under a current density of 5.25 A/dm$^2$. After 12 hours the electrolysis is discontinued. The hydrochloric platinum-iridium-1 solution has a platinum metal content of 550 g/l. 95% of the platinum-iridium granules are dissolved.

Example 3 Dissolution of Platinum-Rhodium-10

The anode compartment of the electrolysis cell subdivided by a cation exchanger membrane is filled with 250 g platinum-rhodium-10 wire remains. A titanium sheet acts as the cathode, and the platinum-rhodium-10 to be dissolved serves as the anode. The electrolysis cell is filled with 8N hydrochloric acid. The temperature of the bath is set in the range of 80° to 100° C. A voltage of 7.5 V is applied across the anode and cathode and the electrolysis process takes place at a current density of 6.6 A/dm$^2$. The hydrochloric acid concentration is monitored during the electrolysis, and the predetermined concentration is maintained by addition of hydrochloric acid.

After a dissolution period of 15 hours the electrolysis is discontinued. The concentration of the platinum metal solution is 330 g/l. Ninety percent of the platinum-rhodium-10 wires have been dissolved.

Example 4 Dissolution of Platinum Metal Biscuit

An electrolysis cell subdivided by a cation exchanger membrane is filled with 300 g platinum biscuit with a composition of 59% platinum, 1% rhodium and 40% palladium. A titanium sheet serves as the cathode and the platinum biscuit serves as the anode. The anode compartment is filled with 1 liter of 6N hydrochloric acid and the cathode compartment with 500 ml of the same. The hydrochloric acid is heated to 60° C. A voltage of 5 V is applied to the electrolysis cell, and the electrolysis is conducted with a current density of 4.4 A/dm$^2$. During the electrolysis the hydrochloric acid concentration is held constant. After 10 hours the electrolysis is discontinued. The concentration of the platinum metal solution is 635 g/l. 98% of the platinum metal biscuit is dissolved.

While the invention has been illustrated and described as embodied in an electrolytic process for dissolving platinum, platinum metal impurities and/or platinum metal alloys, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. Electrolytic process for dissolving platinum, platinum metal impurities and platinum metal alloys in aqueous hydrochloric acid, comprising the steps of:

a) providing an electrolysis cell subdivided into an anode compartment and a cathode compartment by a cation exchanger membrane;

b) providing an anode in said anode compartment and a cathode in said cathode compartment, said anode comprising a platinum-containing body to be dissolved and including at least one member selected from the group consisting of platinum, platinum metal impurities and platinum alloys;

c) placing a portion of 6 to 8N aqueous hydrochloric acid solution in said anode compartment;

d) at least partly filling said cathode compartment with another portion of said 6 to 8N aqueous hydrochloric acid solution;

e) applying a potential between 2.5 V and 8 V across said anode and said cathode under voltage-controlled conditions so as to perform an electrolysis and to dissolve said platinum-containing body in said portion of said aqueous hydrochloric acid at a current density of 0.3 to 7.0 A/dm$^2$ so as to form a platinum-containing solution; and f) during said applying, controlling said potential applied across said anode and said cathode so that chlorine gas is generated, contacting said anode with said hydrochloric acid solution and said chlorine gas and performing said electrolysis at temperatures from 50° to 110° C.

2. Electrolytic process as defined in claim 1, wherein at least one platinum compound selected from the group consisting of platinum metal salts and platinum metal acids is present in said aqueous hydrochloric acid solution in said anode compartment during said applying.

3. Electrolytic process as defined in claim 1, wherein said platinum alloys contain at least one member selected from the group consisting of Rh, Pd, Ir, Au and Ag.

4. Electrolytic process as defined in claim 1, wherein the cathode is made of a material selected from the group consisting of platinum, titanium and graphite.

5. Electrolytic process as defined in claim 1, wherein the cation exchanger membrane comprises a teflon membrane.

6. Electrolytic process as defined in claim 5, wherein the teflon membrane has sulfone group substituents.

7. Electrolytic process as defined in claim 1, wherein said potential is from 5 V to 7.5 V and said current density is 4.4 to 6.6 $A/dm^2$.

8. Electrolytic process as defined in claim 1, further comprising, during said applying, controlling said potential applied across said anode and said cathode so that a hydrochloric acid concentration in said hydrochloric acid solution in said anode compartment remains constant, and compensating for a volume loss of said aqueous hydrochloric acid solution from said anode compartment.

9. Electrolytic process as defined in claim 1, further comprising, during said applying, periodically removing a portion comprising a diluted hydrochloric acid solution from the cathode compartment and compensating for a concentration loss of hydrochloric acid from said aqueous hydrochloric acid solution in said cathode compartment by repeated addition of portions of another concentrated aqueous hydrochloric acid solution to said cathode compartment.

10. Electrolytic process as defined in claim 1, wherein said temperature at which said electrolysis is performed is from 60° to 100° C.

11. Electrolytic process as defined in claim 10, wherein said temperature is about 80° C.

12. Electrolytic process as defined in claim 1, wherein said platinum-containing solution has a platinum metal concentration of 1 to 700 g/l.

13. Electrolytic process as defined in claim 12, wherein said platinum metal concentration of said platinum-containing solution is between 10 and 150 g/l.

14. Electrolytic process as defined in claim 1, wherein said applying of said potential occurs under potentiostatic conditions.

* * * * *